US010762874B2

(12) United States Patent
Yao

(10) Patent No.: US 10,762,874 B2
(45) Date of Patent: Sep. 1, 2020

(54) ELECTRONIC DEVICE AND METHOD FOR CONTROLLING DISPLAY

(71) Applicant: InFoucus Precision Industry (Shenzhen) Co. Ltd, Shenzhen (CN)

(72) Inventor: Le Yao, Shenzhen (CN)

(73) Assignee: InFoucus Precision Industry (Shenzhen) Co. Ltd, Shenzhen (CN)

( * ) Notice: Subject to any disclaimer, the term of this patent is extended or adjusted under 35 U.S.C. 154(b) by 38 days.

(21) Appl. No.: 15/874,883

(22) Filed: Jan. 19, 2018

(65) Prior Publication Data

US 2019/0005918 A1 Jan. 3, 2019

(30) Foreign Application Priority Data

Jun. 30, 2017 (CN) ..... 2017 1 0525188

(51) Int. Cl.

| | |
|---|---|
| ***G09G 5/02*** | (2006.01) |
| ***G09G 5/14*** | (2006.01) |
| ***G09G 3/20*** | (2006.01) |

(52) U.S. Cl.

CPC ..... *G09G 5/02* (2013.01); *G09G 3/2003* (2013.01); *G09G 5/026* (2013.01); *G09G 5/14* (2013.01); *G09G 2320/0666* (2013.01); *G09G 2320/0686* (2013.01); *G09G 2320/08* (2013.01)

(58) Field of Classification Search

CPC ..... G06T 15/503; G06T 11/001; G06T 11/60; G09G 2349/10; G09G 5/393

USPC ..... 345/593

See application file for complete search history.

(56) References Cited

U.S. PATENT DOCUMENTS

| | | | | |
|---|---|---|---|---|
| 8,451,414 | B2 * | 5/2013 | Nonaka | G02F 1/133514 349/146 |
| 2010/0214195 | A1 * | 8/2010 | Ogasawara | G02F 1/136286 345/55 |
| 2015/0179139 | A1 * | 6/2015 | Watanabe | G09F 9/33 345/592 |
| 2018/0128973 | A1 * | 5/2018 | Powell | G02B 6/06 |

* cited by examiner

*Primary Examiner* — Gordon G Liu
(74) *Attorney, Agent, or Firm* — ScienBiziP, P.C.

(57) ABSTRACT

An electronic device with irregularly-shaped display also includes a storage device, and at least one processor. The display screen includes a corner and first, second, and third display areas. The first display area is the outermost display area and the third display area is the innermost. The first display area displays a first color, and the third display area displays a second color. The processor can set the color of the middle display area (the second display area) according to the first color and the second color.

15 Claims, 5 Drawing Sheets

ELECTRONIC DEVICE AND METHOD FOR CONTROLLING DISPLAY

CROSS-REFERENCE TO RELATED APPLICATIONS

This application claims priority to Chinese Patent Application No. 201710525188.5 filed on Jun. 30, 2017, the contents of which are incorporated by reference herein.

FIELD

The subject matter herein generally relates to display technology, and particularly to an electronic device and method for controlling display.

BACKGROUND

Electronic devices, such as mobile phones, are equipped with a display screen. The display screen can be a standard rectangular, and can be irregular in shape. The irregular display screen can be produced by cutting off four corners of the standard rectangular display screen. However, the corners of the cut display screen can affect at least part of the display.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
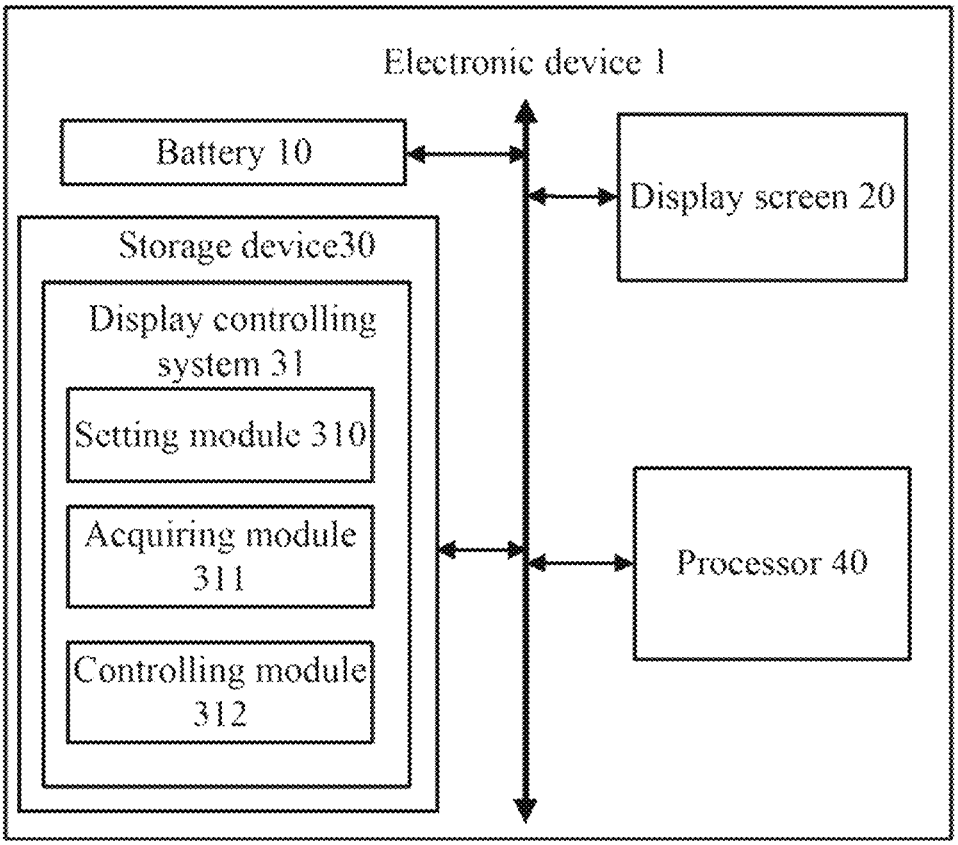
FIG. 1 is a block diagram of one embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The present disclosure, including the accompanying drawings, is illustrated by way of examples and not by way of limitation. It should be noted that references to "an" or "one" embodiment in this disclosure are not necessarily to the same embodiment, and such references mean "at least one."

The term "module", as used herein, refers to logic embodied in hardware or firmware, or to a collection of software instructions, written in a programming language, such as, Java, C, or assembly. One or more software instructions in the modules can be embedded in firmware, such as in an EPROM. The modules described herein can be implemented as either software and/or hardware modules and can be stored in any type of non-transitory computer-readable medium or other storage device. Some non-limiting examples of non-transitory computer-readable media include CDs, DVDs, BLU-RAY™, flash memory, and hard disk drives. The term "comprising" means "including, but not necessarily limited to"; it specifically indicates open-ended inclusion or membership in a so-described combination, group, series and the like.

FIG. 1 is a block diagram of one embodiment of an electronic device. Depending on the embodiment, the electronic device 1 can include, but is not limited to, a battery 10, a display screen 20, a storage device 30, and at least one processor 40. The above components communicate with each other through a system bus. In at least one embodiment, the electronic device 1 can be a mobile phone, a tablet computer, a smart watch, or any other suitable device configured with a display device. In at least one embodiment, the electronic device 1 further includes a non-display area 50. The non-display area 50 can be occupied by a casing, or a camera. FIG. 1 illustrates only one example of the electronic device 1, other examples can include more or fewer components than illustrated, or have a different configuration of the various components in other embodiments.

In at least one embodiment, the battery 10 can supply power for the electronic device 1. The battery 10 can be a lithium battery or a nickel-metal hydride battery (NI-MH) battery.

Figure 2:
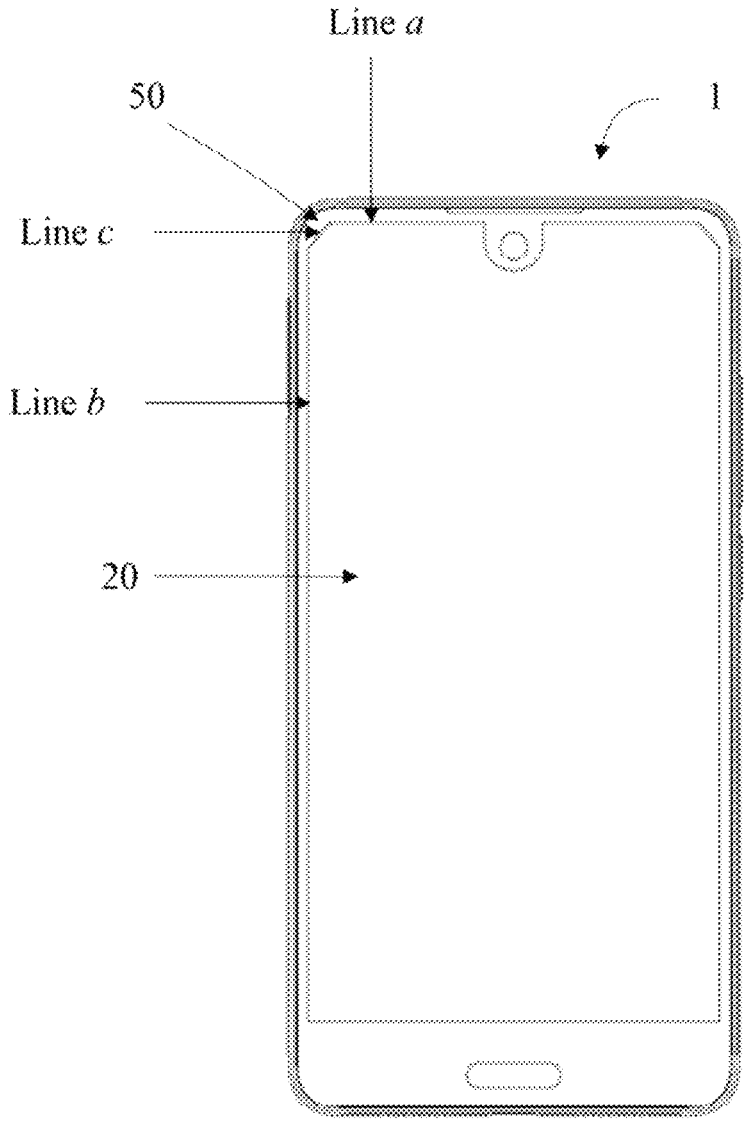
FIG. 2 is a schematic diagram of one exemplary embodiment of a display screen of the electronic device of FIG. 1.

In at least one embodiment, the display screen 20 can be a liquid crystal display (LCD) or an organic light-emitting diode (OLED) display screen. The display screen 20 can detect touch events on one or more positions of the display screen 20. The touch events include the user touching the display screen 20, a contact position generated by the touch on the display screen 20, and whether the touch on the display screen 20 is moving or static. The display screen 20 can display images, videos and so on. The top left corner, the top right corner, and the top center of the display screen 20 are cut, as shown in FIG. 2. For example, the top left corner and the top right corner of the display screen 20 are cut by lines, and the top center of the display screen 20 is cut by curved area, the geometric regularity of the rectangle is thereby infringed. The cut display screen 20 can include a corner (e.g., the top left corner or the top right corner) formed by three intersecting straight edges of the display screen 20. For example, the top left corner is a right angle which is formed by perpendicular straight line a and straight line b before the display screen 20 is cut. After cutting, the top left corner is cut by a straight line c, and an angle between the straight line c and a horizontal line is 45°, the top left corner being formed by three intersecting straight lines (line a, line b, and line c). The cut display screen 20 further includes two corners formed by an intersection of a straight edge and an arc edge. The cut display screen 20 further includes two right angles, for example, the bottom left corner and the bottom right corner.

Figure 3:
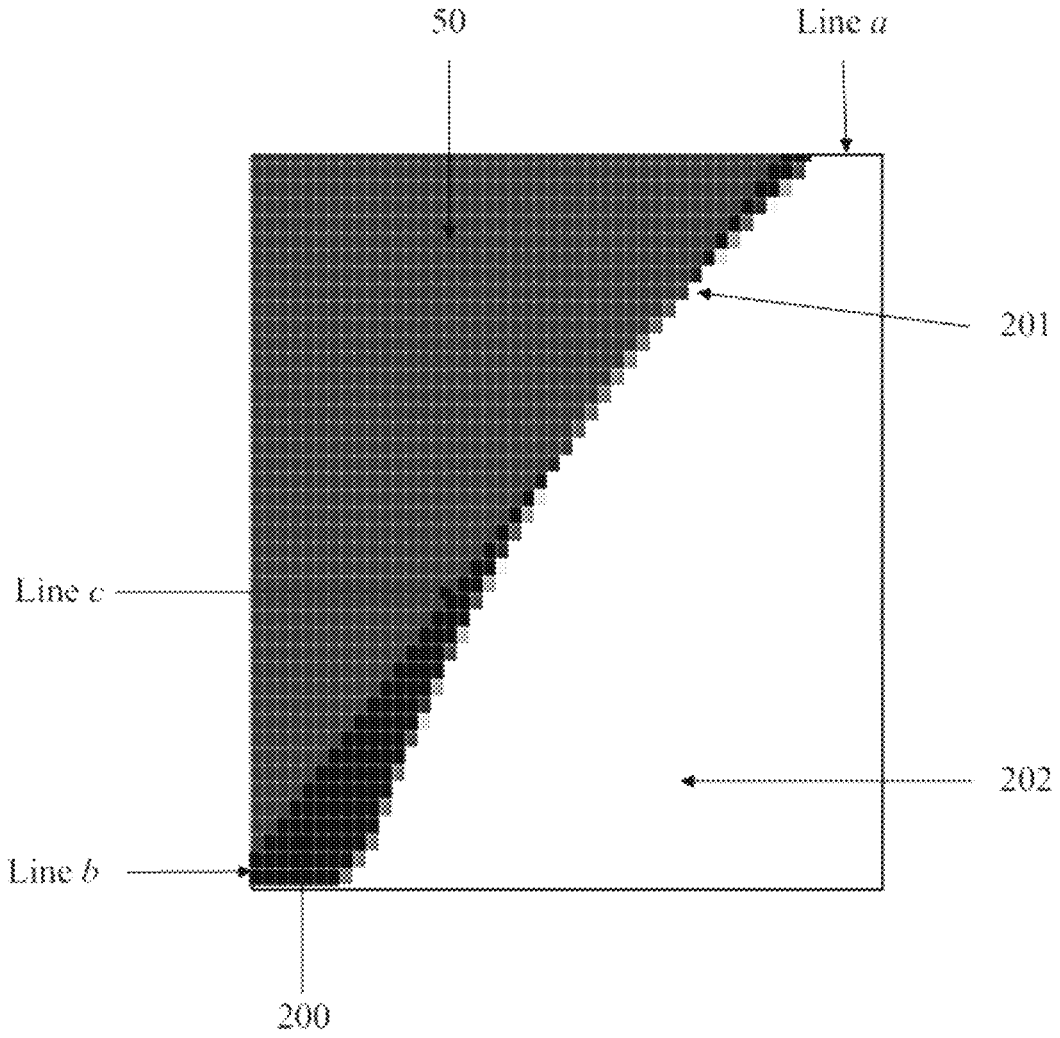
FIG. 3 shows the top left corner of the display screen cut by a straight line.

FIG. 3 shows the top left corner of the display screen cut by a straight line. The display screen 20 includes at least one corner, and the at least one corner is non-arc-shaped and formed by at least two intersecting edges. The display screen 20 further includes a first display area 200, a second display area 201, and a third display area 202. The second display area 201 connects between the edges that form the corner. For example, when the corner (as is the top left corner in FIG. 2) is formed by three intersecting straight edges (straight line a, straight line b, and straight line c), the second display area 201 connects between the two straight lines (straight line a, and straight line b) which are perpendicular.

In at least one exemplary embodiment, the first display area 200 is located between the non-display area 50 and the second display area 201, and the second display area 201 is located between the first display area 200 and the third display area 202. The third display area 202 is adjacent to one side of the second display area 201 away from the non-display area 50. The second display area 201 is adjacent to both of the first display area 200 and the third display area 202. The shape of the second display area 201 is an arc.

In at least one exemplary embodiment, the first display area 200 can display a first color, and the first color is the same as the color of the non-display area 50. For example, when the non-display area 50 is a white casing, the first color is white. When the non-display area 50 contains a black camera, the first color is black.

In at least one exemplary embodiment, the third display area 202 can display a second color, and the second color is the color of the third display area 202 adjacent to the second display area 201. For example, when an image with color is displayed on the third display area 202, the color displayed on the third display area 202 includes red, green, blue, violet, and so on, and the color of the third display area 202 which is adjacent to the second display area 201 is violet. Thus the second color is violet.

In at least one exemplary embodiment, the color of the second display area 201 is a medium color between the first color and the second color. For example, the first color displayed by the first display area 200 is white (255, 255, 255), and the second color displayed by the third display area 202 is black (0, 0, 0). Then, the color of the second display area 201 is (128, 128, 128), that is, the color of the second display area 201 is gray.

In at least one exemplary embodiment, the medium color can further include many kinds of different colors. For example, when the first color of the first display area 200 is white and the second color of the third display area 202 is black, the medium color of the second display area 201 can include many shades of gray (e.g., light gray, dark gray, etc.). When the first color of the first display area 200 is red and the second color of the third display area 202 is yellow, the medium color of the second display area 201 can include many kinds of different colors which gradually change from red to orange to yellow. In at least one exemplary embodiment, the medium color can be set the same as the first color or the second color.

Figure 4:
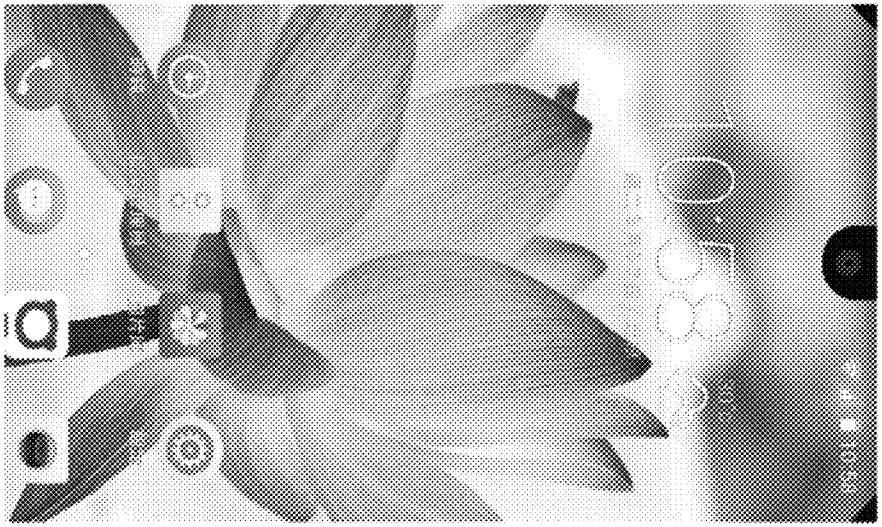
FIG. 4 illustrates an example of an unchanged display screen of the electronic device of FIG. 2.
Figure 5:
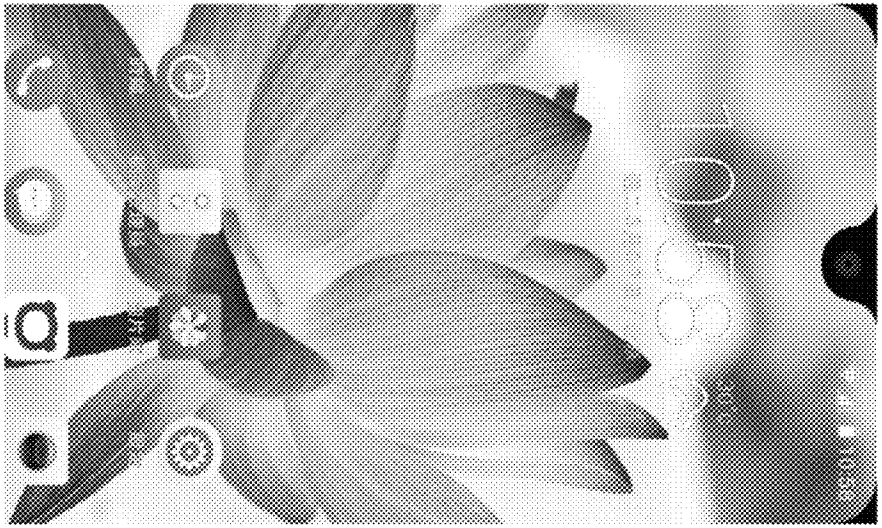
FIG. 5 illustrates an example of a changed display screen of the electronic device of FIG. 2.

In at least one exemplary embodiment, changing the color of the second display area 201 can visually change the shape of the edge of the display screen 20. For example, when the color of the second display area 201 is not changed, the shape of the edge of the display screen 20 is the shape as shown in FIG. 4. When the color of the second display area 201 is changed, the shape of the edge of the display screen 20 is changed, as shown in FIG. 5. Refer to FIG. 4 and FIG. 5, it can be seen that the sharp corners of the top of the display screen 20 of FIG. 4 are changed to curved corners (as shown in FIG. 5). The edges of the display screen 20 are not visually sharp when the color of the second display area 201 is changed.

In other exemplary embodiment, the two right angles can also be changed to curved corners.

In at least one embodiment, the storage device 30 can be a memory of the electronic device 1. In other embodiments, the storage device 30 can be a secure digital card, or other external storage device such as a smart media card. In at least one embodiment, the storage device 30 can store a number of operation modes, for example, a first operation mode and a second operation mode. The operation mode can be defined as executing applications of the electronic device 1. For example, the first operation mode can be defined as viewing images of an image gallery, and the second operation mode can be defined as playing video. The second color can be changed when the electronic device 1 switches from an operation mode to another operation mode. For example, when the electronic device 1 is executing the first operation mode, the second color can be the same as the color of the images of the image gallery displayed by the display screen 20, and when the electronic device 1 is executing the second operation mode, the second color can be the same as the color of the video displayed by the display screen 20.

In at least one embodiment, the shape of the second display area 201 can be changed when the electronic device 1 switches from an operation mode to another operation mode. For example, when the electronic device 1 is executing the first operation mode, the first display area 200 can display multiple colors including the first color, and the third display area 202 can display multiple colors including the second color. Then, the color of the second display area 201 is the medium color between the first color and the second color, the sharply-delineated corners of the display screen 20 can be changed into arc-shaped corners. Then the shape of the second display area 201 is an arc. When the electronic device 1 is executing the second operation mode, the third display area 200 can display multiple colors including the second color, and the first display area 200 and the second display area 201 can display colors the same as the colors of an extension of the display content of the third display area 202. The sharply-delineated corners of the display screen 20 do not need to be modified. Herein, the shape of the second display area 201 is non-arc.

In at least one embodiment, the storage device 30 can store a display controlling system 31. The display controlling system 31 can change display effect of the edges of the display screen 20. In at least one embodiment, the display controlling system 31 can include a setting module 310, an acquiring module 311, and a controlling module 312. The modules 310-312 include computerized codes in the form of one or more programs that may be stored in the storage device 30. The computerized codes include instructions that are executed by the at least one processor 40.

The at least one processor 40 can be a central processing unit (CPU), a microprocessor, or other data processor chip that performs functions of the electronic device 1.

Figure 6:
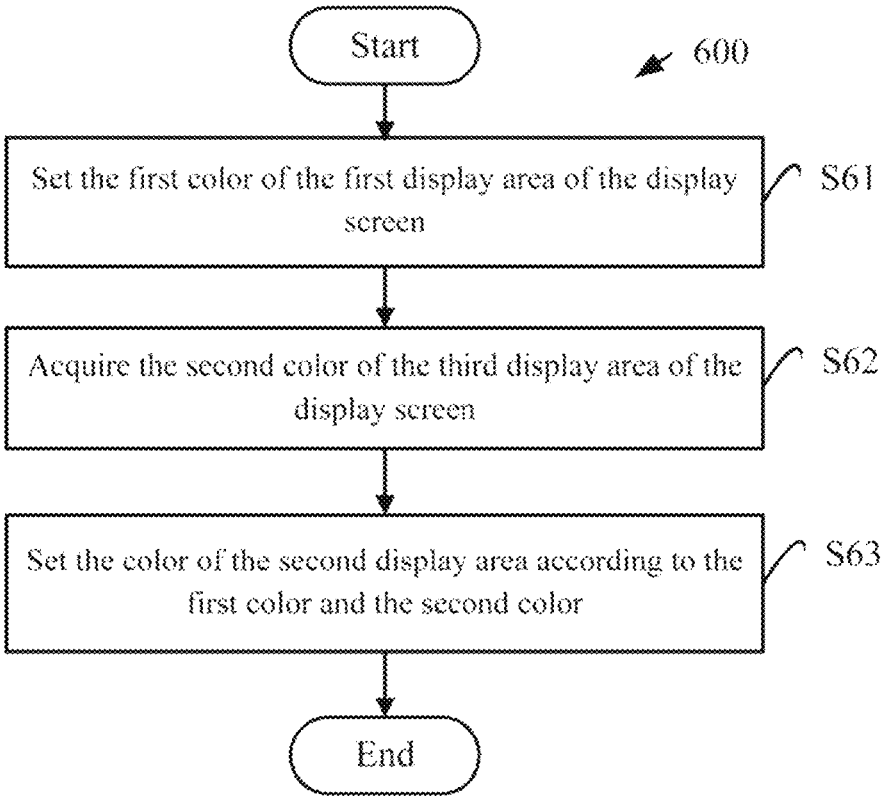
FIG. 6 illustrates a flowchart of one embodiment of a display control method using the electronic device of FIG. 1.

FIG. 6 illustrates a flowchart which is presented in accordance with an example embodiment. The exemplary method 600 is provided by way of example, as there are a variety of ways to carry out the method. The method 600 described below can be carried out using the configurations illustrated in FIG. 6, for example, and various elements of these figures are referenced in explaining exemplary method 600. Each block shown in FIG. 6 represents one or more processes, methods, or subroutines, carried out in the exemplary method 600. Additionally, the illustrated order of blocks is by example only and the order of the blocks can be changed according to the present disclosure. The exemplary method 600 can begin at block S61. Depending on the embodiment, additional steps can be added, others removed, and the ordering of the steps can be changed.

At block S61, the setting module 310 can set the first color of the first display area 200 of the display screen 20 the same as the color of the non-display area 50. In at least one exemplary embodiment, the display screen 20 includes at least one corner, and the at least one corner is non-arc-shaped and formed by at least two intersecting edges. The display screen 20 further includes a first display area 200, a second display area 201, and a third display area 202. The second display area 201 connects between the edges that form the corner. The first display area 200 is located between the non-display area 50 and the second display area 201, and the second display area 201 is located between the first display area 200 and the third display area 202. The third display area 202 is adjacent to one side of the second display area 201 away from the non-display area 50. The second display area 201 is adjacent to both of the first display area 200 and the third display area 202.

At block S62, the acquiring module 311 can acquire the second color of the third display area 202 of the display screen 20. The second color is the color of the third display area 202 which is adjacent to the second display area 201. For example, when an image with color is displayed on the third display area 202, the color displayed on the third display area 202 includes red, green, blue, violet, and so on, and the color of the third display area 202 which is adjacent to the second display area 201 is violet. Thus the second color is violet.

At block S63, the controlling module 312 can set the color of the second display area 201 according to the first color and the second color. The controlling module 312 can set the color of the second display area 201 the same as a medium color between the first color and the second color. In other exemplary embodiment, the controlling module 312 can set the color of the second display area 201 the same as the first color or the second color.

From the above blocks S61 to S63, the display controlling system 31 can visually change the shape of the edges of the display screen 20. Then, the edges of the display screen 20 are not sharp.

In at least one exemplary embodiment, the method 600 further include a step before the block S61, the setting module 310 can determine whether to change the display effect of the edges of the display screen 20. The display effect of the edges of the display screen 20 is different when the electronic device 1 switches from an operation mode to another operation mode. When the setting module 310 determines to change the display effect of the edges of the display screen 20, the process can execute the block 61 to block 63. When the setting module 310 determines not to change the display effect of the edges of the display screen 20, the process ends.

In at least one exemplary embodiment, when the electronic device 1 is executing the first operation mode, the setting module 310 can determine to change the display effect of the edges of the display screen 20 and set the first color of the first display area 200 the same as the color of the non-display area 50, and the acquiring module 311 can acquire the second color of the third display area 202. The controlling module 312 can set the color of the second display area 201 the same as a medium color between the first color and the second color. Then, the sharp corner formed by two intersecting edges of the display screen 20 can be visually changed to be arc-shaped. When the electronic device 1 is executing the second operation mode, the setting module 310 can determine not to change the display effect of the edges of the display screen 20. Then, the third display area 200 can display multiple colors including the second color, and the first display area 200 and the second display area 201 can display colors the same as the colors of an extension of the display content of the third display area 202. The sharp corners formed by two intersecting edges of the display screen 20 do not need to be modified.

In at least one exemplary embodiment, the second color can be changed when the electronic device 1 switches from an operation mode to another operation mode. For example, when the electronic device 1 is executing the first operation mode, the second color can be the same as the color of the images of the image gallery displayed by the display screen 20, and when the electronic device 1 is executing the second operation mode, the second color can be the same as the color of the video displayed by the display screen 20.

It should be emphasized that the above-described embodiments of the present disclosure, including any particular embodiments, are merely possible examples of implementations, set forth for a clear understanding of the principles of the disclosure. Many variations and modifications can be made to the above-described embodiment(s) of the disclosure without departing substantially from the spirit and principles of the disclosure. All such modifications and variations are intended to be included herein within the scope of this disclosure and protected by the following claims.

What is claimed is:

1. An electronic device comprising:

a display screen comprising a corner, a non-display area, a first display area, a second display area, and a third display area, wherein the corner is formed by at least two intersecting edges of the display screen, the second display area connects between the at least two intersecting edges, the first display area is located between the non-display area and the second display area, and the third display area is adjacent to one side of the second display area away from the non-display area, the second display area is located between the first display area and the third display area, the second display area is adjacent to both of the first display area and the third display area, the first display area displays a first color, and the third display area displays a second color;

a storage device; and at least one processor, wherein the storage device stores one or more programs that, when executed by the at least one processor, cause the at least one processor to set the color of the second display area according to the first color and the second color, and change a shape of the second display area when the electronic device switches between operation modes, wherein the operation mode comprises executing applications of the electronic device.

2. The electronic device according to claim 1, wherein the corner is non-arc-shaped.

3. The electronic device according to claim 1, wherein the first color is the same as a color of the non-display area.

4. The electronic device according to claim 1, wherein the second display area is arc-shaped.

5. The electronic device according to claim 1, wherein the color of the second display area is the same as the first color, or the second color, or a medium color between the first color and the second color.

6. The electronic device according to claim 1, wherein the second color changes when the electronic device switches between the operation modes.

7. The electronic device according to claim 6, wherein when the electronic device switches between the operation modes, the least one processor further changes a display color of the first display area to colors of extensions of display contents on the third display area.

8. The electronic device according to claim 1, wherein the corner is formed by at least two intersecting straight edges of the display screen, or formed by an intersection of a straight edge and an arc edge of the display screen.

9. A non-transitory storage medium having stored thereon instructions that, when executed by a processor of an electronic device, causes the processor to perform a method for display controlling, the electronic device comprising a display screen and a non-display area, wherein the display screen comprising a corner, a non-display area, a first display area, a second display area, and a third display area;

wherein the corner is formed by at least two intersecting edges of the display screen, the second display area connects between the at least two intersecting edges, the first display area is located between the non-display area and the second display area, and the third display area is adjacent to one side of the second display area away from the non-display area, the second display area is located between the first display area and the third display area, the second display area is adjacent to both of the first display area and the third display area, the first display area displays a first color, and the third display area displays a second color;

wherein the method comprises:

setting the first color of the first display area of the display screen the same as the color of the non-display area;

acquiring the second color of the third display area of the display screen;

setting the color of the second display area according to the first color and the second color; and changing a shape of the second display area when the electronic device switches between operation modes, wherein the operation mode comprises executing applications of the electronic device.

10. The non-transitory storage medium according to claim 9, wherein the corner is non-arc-shaped.

11. The non-transitory storage medium according to claim 9, wherein the second display area is arc-shaped.

12. The non-transitory storage medium according to claim 9, wherein the second color changes when the electronic device switches between the operation modes.

13. A display controlling method applied in an electronic device, the electronic device comprising a display screen, a non-display area, wherein the display screen comprising a corner, a non-display area, a first display area, a second display area, and a third display area, wherein the corner is formed by at least two intersecting edges of the display screen, the second display area connects between the at least two intersecting edges, the first display area is located between the non-display area and the second display area, and the third display area is adjacent to one side of the second display area away from the non-display area, the second display area is located between the first display area and the third display area, the second display area is adjacent to both of the first display area and the third display area, the first display area displays a first color, and the third display area displays a second color;

the method comprising:

setting the first color of the first display area of the display screen the same as the color of the non-display area;

acquiring the second color of the third display area of the display screen;

setting the color of the second display area according to the first color and the second color; and changing a shape of the second display area when the electronic device switches between operation modes, wherein the operation mode comprises executing applications of the electronic device.

14. The method according to claim 13, wherein the corner is non-arc-shaped.

15. The method according to claim 13, wherein the second display area is arc-shaped.

* * * * *